US011798765B2

(12) United States Patent
Kobayashi et al.

(10) Patent No.: US 11,798,765 B2
(45) Date of Patent: Oct. 24, 2023

(54) ELECTROMAGNETIC RELAY

(71) Applicant: Fujitsu Component Limited, Tokyo (JP)

(72) Inventors: Koyuru Kobayashi, Tokyo (JP); Kazuaki Miyanaga, Tokyo (JP); Katsuyuki Takahashi, Tokyo (JP); Masahide Mochizuki, Tokyo (JP); Shigeki Nakayama, Tokyo (JP); Natsumi Sakai, Tokyo (JP); Hiroaki Kohinata, Tokyo (JP); Daishi Kitajima, Tokyo (JP); Satoshi Matsumoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 190 days.

(21) Appl. No.: 16/518,719

(22) Filed: Jul. 22, 2019

(65) Prior Publication Data

US 2020/0043687 A1 Feb. 6, 2020

(30) Foreign Application Priority Data

Jul. 31, 2018 (JP) ..... 2018-143628

(51) Int. Cl.
*H01H 50/02* (2006.01)
*H01H 51/29* (2006.01)

(52) U.S. Cl.
CPC ..... *H01H 50/023* (2013.01); *H01H 51/29* (2013.01); *H01H 2223/044* (2013.01)

(58) Field of Classification Search
CPC ..... H01H 50/023; H01H 51/029; H01H 2223/044; H01H 50/02
USPC ..... 335/202
See application file for complete search history.

(56) References Cited

U.S. PATENT DOCUMENTS 4,349,693 A * 9/1982 Hinrichs ..... H05K 5/0095 264/272.11
4,480,243 A * 10/1984 Minks ..... H01H 50/023 174/528
4,675,987 A * 6/1987 Minks ..... H01H 50/023 53/404
4,975,545 A * 12/1990 China ..... H01H 50/12 174/547

(Continued)

FOREIGN PATENT DOCUMENTS

JP S5377337 U 6/1978
JP S5731751 U 2/1982

(Continued)

OTHER PUBLICATIONS

The Notification of Reasons for Refusal, and translation thereof, from counterpart Japanese Application No. 2018-143628, dated Apr. 5, 2022, 6 pp.

(Continued)

*Primary Examiner* — Alexander Talpalatski
(74) *Attorney, Agent, or Firm* — Shumaker & Sieffert, P.A.

(57) ABSTRACT

An electromagnetic relay including a housing, a cover, an adhesive which is interposed between a side part of the housing and an inner surface of the cover and which secures the housing and the cover, and a projection which is formed in at least one of the side part and the inner surface. The adhesive is filled in a gap between the side part and the inner surface.

3 Claims, 11 Drawing Sheets

(56) References Cited

U.S. PATENT DOCUMENTS 5,079,387 A * 1/1992 Weaver ..... H01H 50/02 228/110.1
5,911,588 A * 6/1999 Kern ..... H01H 50/023 29/745
7,157,996 B2 * 1/2007 Enomoto ..... H01H 50/02 335/126
7,323,957 B2 * 1/2008 Menard ..... H01H 61/0107 200/260
9,754,747 B1 9/2017 Yeh
2005/0270129 A1 * 12/2005 Menard ..... H01H 61/0107 335/83
2015/0155759 A1 * 6/2015 Matsuo ..... H02K 11/215 310/52
2015/0171709 A1 * 6/2015 Ito ..... H02K 5/225 310/52
2015/0333600 A1 * 11/2015 Nakano ..... H02K 11/33 310/68 B
2016/0204670 A1 * 7/2016 Yamasaki ..... H02K 11/215 310/71
2017/0076893 A1 3/2017 Tsutsui et al.
2017/0229270 A1 * 8/2017 Liang ..... H01H 50/047
2018/0219449 A1 * 8/2018 Yamamoto ..... H02K 11/33
2018/0287455 A1 * 10/2018 Uematsu ..... H02K 5/225
2019/0207474 A1 * 7/2019 Uematsu ..... H02K 21/14
2019/0214926 A1 * 7/2019 Sato ..... F04C 2/10

FOREIGN PATENT DOCUMENTS

JP S61119237 A 6/1986
JP H0778540 A 3/1995
JP 2000260283 A 9/2000
JP 2002367498 A 12/2002
JP 2015176754 A 10/2015

OTHER PUBLICATIONS

The Notification of Reasons for Refusal, and translation thereof, from counterpart Japanese Application No. 2018-143628, dated Aug. 9, 2022, 4 pp.

* cited by examiner

ELECTROMAGNETIC RELAY

CROSS-REFERENCE TO RELATED APPLICATIONS

This application is based upon and claims the benefit of priority of the prior Japanese Patent Application No. 2018-143628, filed Jul. 31, 2018, the entire contents of which are incorporated herein by reference.

TECHNICAL FIELD

The present invention relates to an electromagnetic relay, and in particular, relates to a sealed-type electromagnetic relay the interior of which is sealed by an adhesive.

BACKGROUND

Electromagnetic relays in which the contacts are opened and closed by an electromagnet are known. Japanese Unexamined Utility Model Publication No. S61-119237 (JP S61-119237 U) discloses an electromagnetic relay the interior of which is sealed by the application of an adhesive to a gap between a housing, which houses the constituent components of the electromagnetic relay, and a cover.

SUMMARY

In sealed-type electromagnetic relays, the cover is a thin molded part made of a resin. Since distortion may occur in the thin cover in some cases, the gap between the case and the cover may not be uniform, and the gap between the case and the cover may be small, depending on the position.

When the gap between the case and the cover becomes small, adhesive may not sufficiently flow into the gap, whereby sealing failure of the electromagnetic relay may occur in some cases.

According to one aspect, the electromagnetic relay comprises a housing, a cover, an adhesive which is interposed and filled in a gap between a side part of the housing and an inner surface of the cover, and a projection which is formed on at least one of the side part and the inner surface.

According to the electromagnetic relay of one aspect, a sealed-type electromagnetic member having no sealing failures can be provided.

DETAILED DESCRIPTION

The embodiments of an electromagnetic relay (hereinafter, "relay") will be described below with reference to the attached drawings. The relay includes a housing and a cover, and the interior of the relay is sealed by an adhesive.

Figure 1:
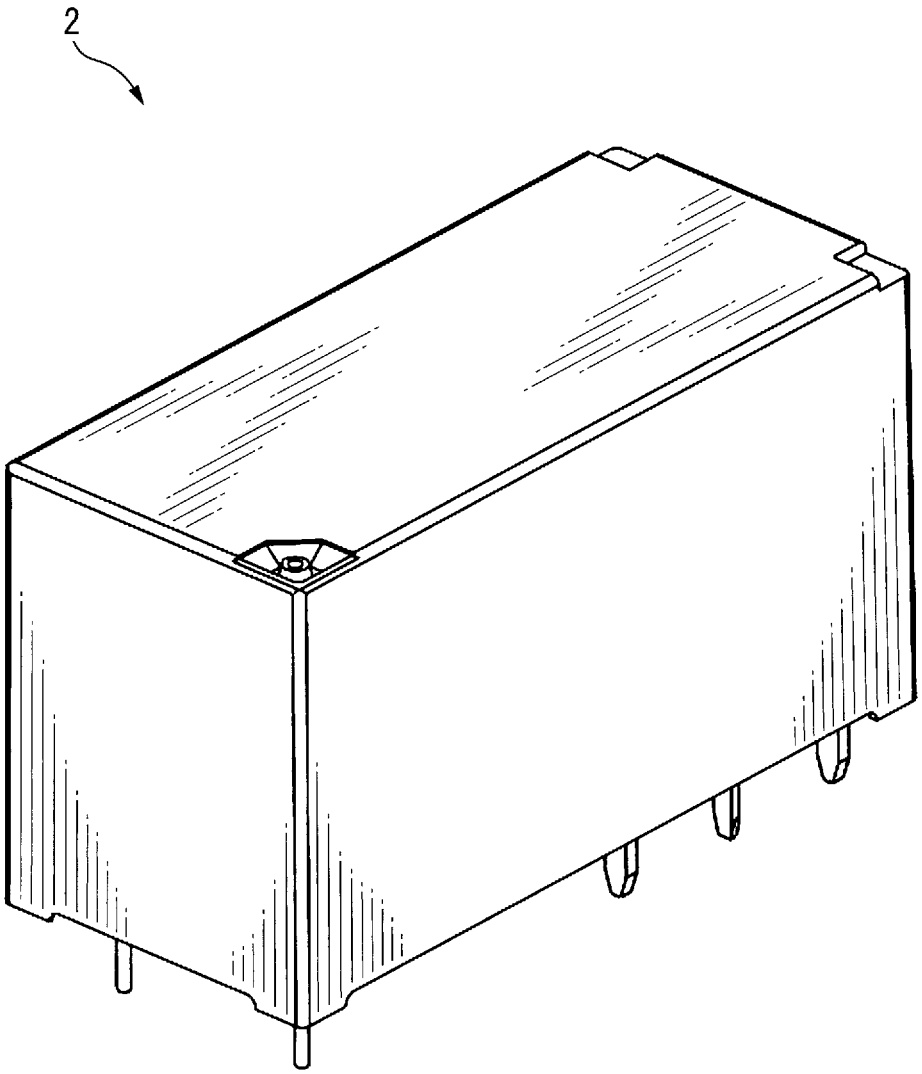
FIG. 1 is a perspective view of the electromagnetic relay according to a first embodiment.
Figure 2:
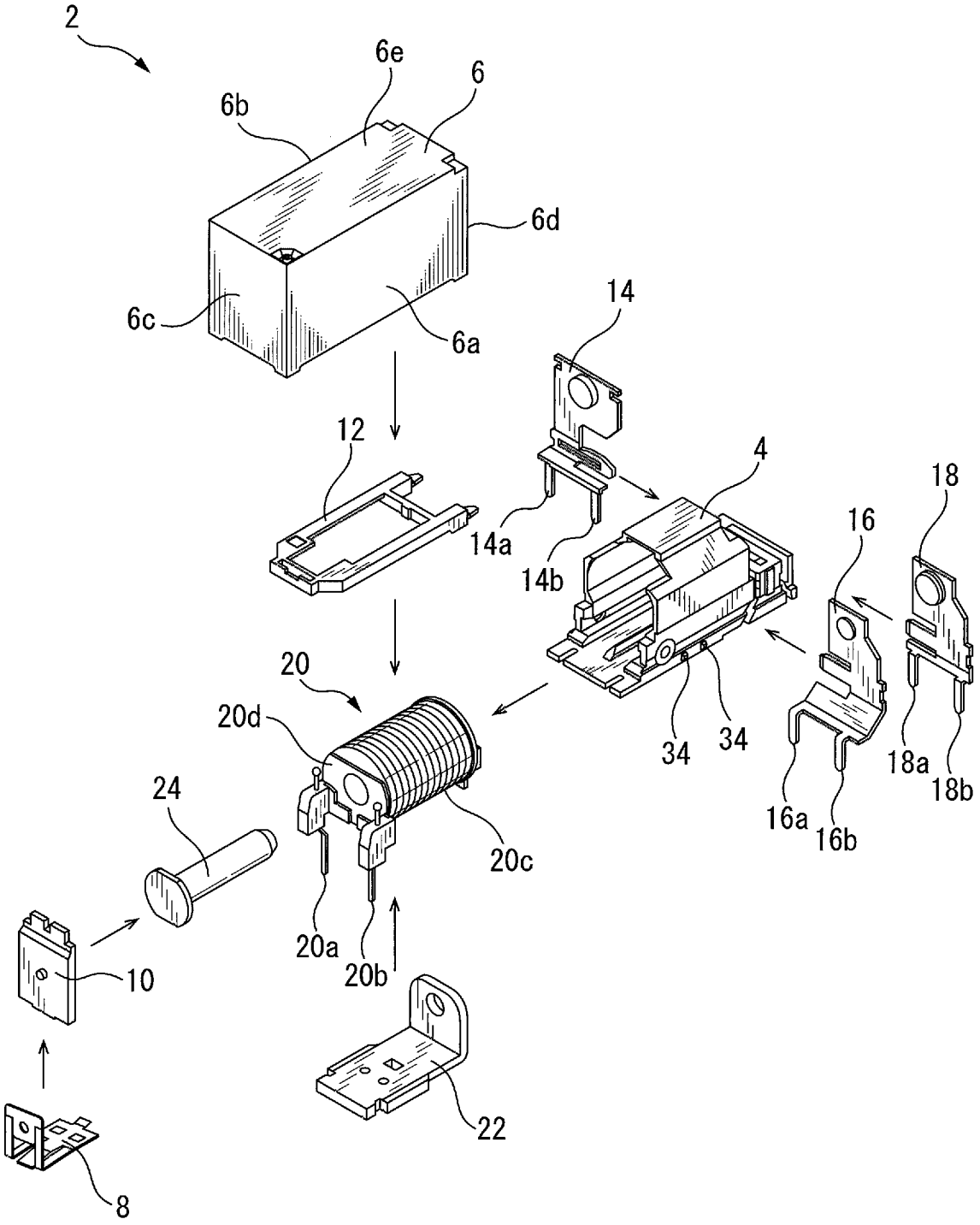
FIG. 2 is an exploded perspective view of the electromagnetic relay.

FIG. 1 is a perspective view of relay 2. FIG. 2 is an exploded perspective view of the relay 2. The relay 2 includes a housing 4 in which constituent components are incorporated, and a box-shaped cover 6 which encloses the housing 4. For example, the housing 4 and the cover 6 are molded parts made of a resin.

The components incorporated in the housing 4 include contact springs, an electromagnet, a hinge spring 8, an armature 10, and a card 12. The contact spring includes a movable spring 14 having terminals 14*a* and 14*b*, a fixed break spring 16 having terminals 16*a* and 16*b*, and a fixed make spring 18 having terminals 18*a* and 18*b*. The electromagnet includes a coil assembly 20, a yoke 22, and an iron core 24. The coil assembly 20 includes terminals 20*a* and 20*b*, a coil 20*c*, and a bobbin 20*d* on which the coil 20*c* is wound.

The relay 2 excites the electromagnet when a voltage is applied between the terminals 20*a* and 20*b*. The armature 10 is attracted to the iron core 24 due to the excitation of the electromagnet. The card 12 is associated with the armature 10, and the movable spring 14 moves in accordance with the attraction of the armature 10 to iron core 24, whereby the movable spring 14 and the make spring 18 are brought into contact with each other. In a state in which the electromagnet is not excited, the movable spring 14 and the break spring 16 contact each other. The hinge spring 8 is attached to the armature 10 and the yoke 22 so as to elastically bias the armature 10 away from the iron core 24.

Accordingly, the relay 2 opens and closes the contacts. The configuration described above is one example, and arbitrary components and principles can be used. For example, the break-side contact spring may be omitted.

Figure 3:
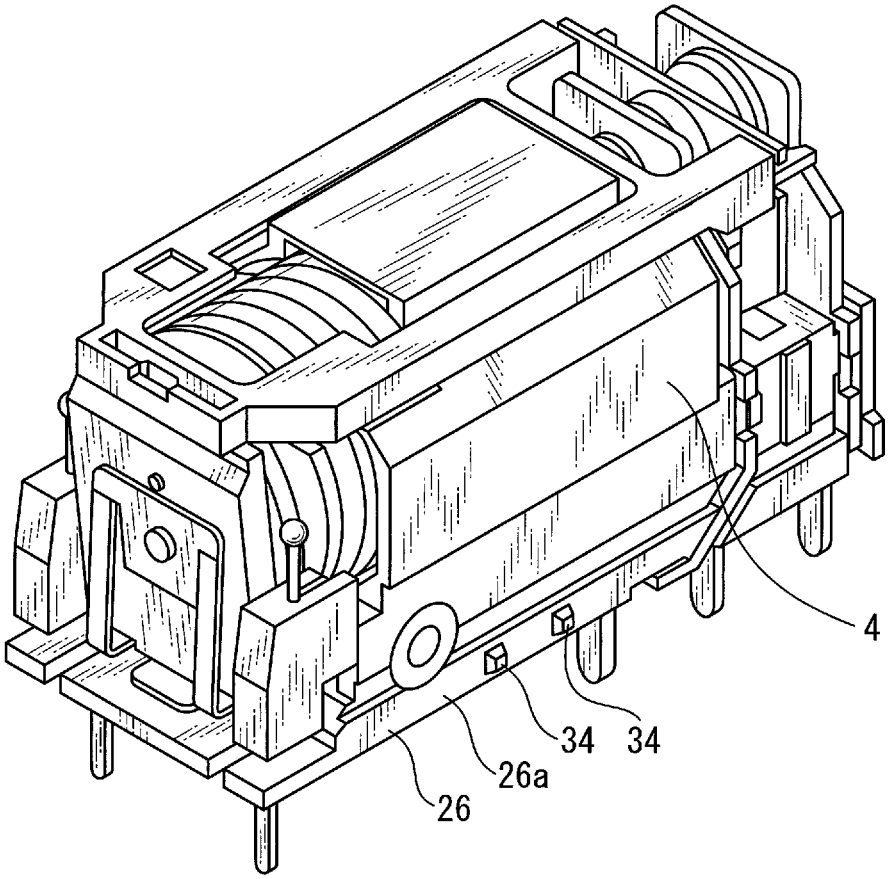
FIG. 3 is a perspective view of the electromagnetic relay in which the cover has been removed.
Figure 4:
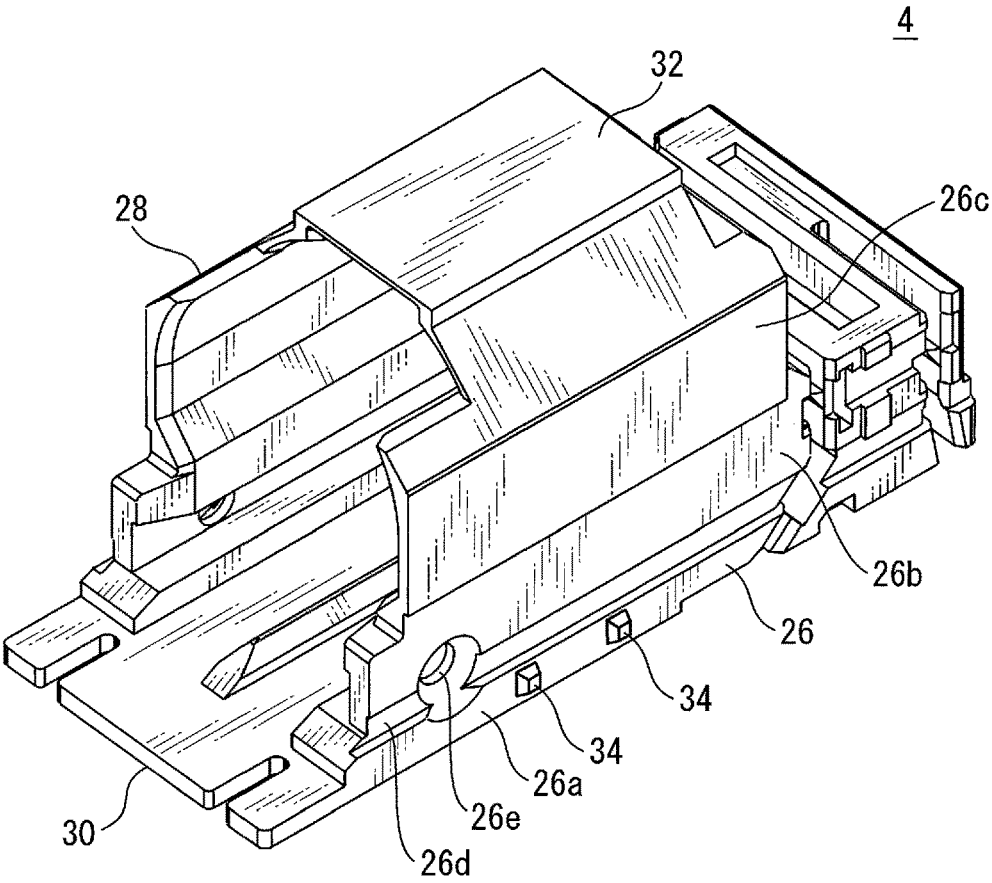
FIG. 4 is a perspective view of a housing according to the first embodiment.
Figure 5:
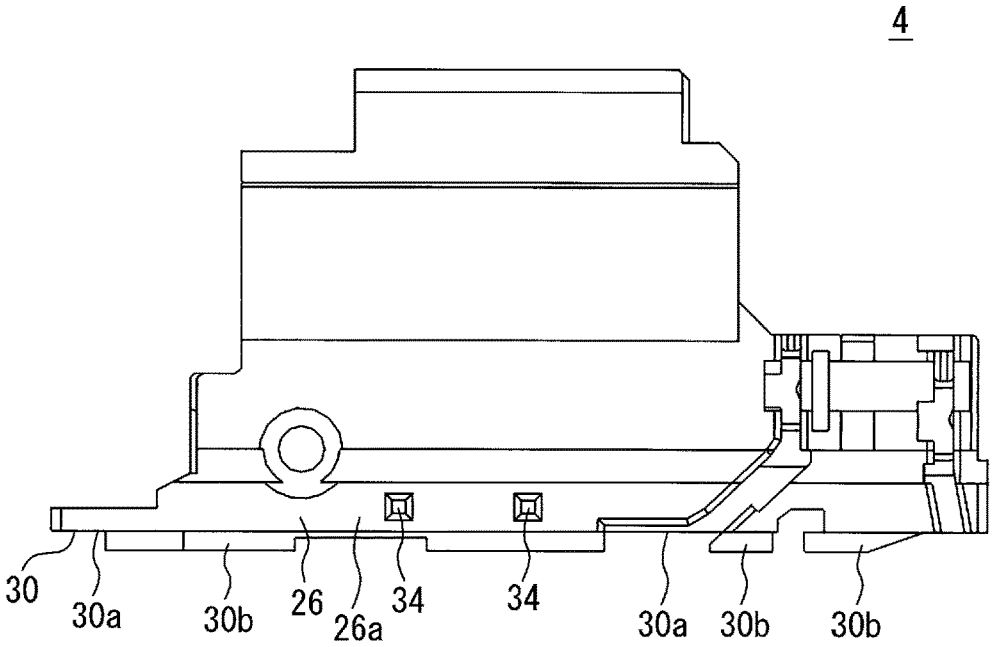
FIG. 5 is a side view of the housing.

FIG. 3 is a perspective view of the relay 2 from which the cover has been removed. FIG. 4 is a perspective view of the housing 4. FIG. 5 is a side view of the housing 4.

As illustrated in FIG. 4, the housing 4 includes side parts 26 and 28, a bottom part 30, and a top part 32. The side part 26 includes surfaces 26*a*, 26*b*, and 26*c*, a recess 26*d*, and an aperture 26*e*. As illustrated in FIG. 5, the bottom part 30 includes a surface 30*a*, and a protrusion 30*b*.

Projections 34 are formed on the portion of the surface 26*a* closest to the bottom part 30. An arbitrary number of projections 34 are formed. The side part 26 may not include the recess 26*d* and the aperture 26*e*. Furthermore, the entirety of the side part 26 may be formed as a single surface. The side part 28 has the same configuration as the side part 26.

As illustrated in FIG. 2, the cover 6 includes side parts 6*a* and 6*b*, side parts 6*c* and 6*d*, and a top part 6*e*. The cover 6 is open at the lower side of the relay 2.

Figure 6:
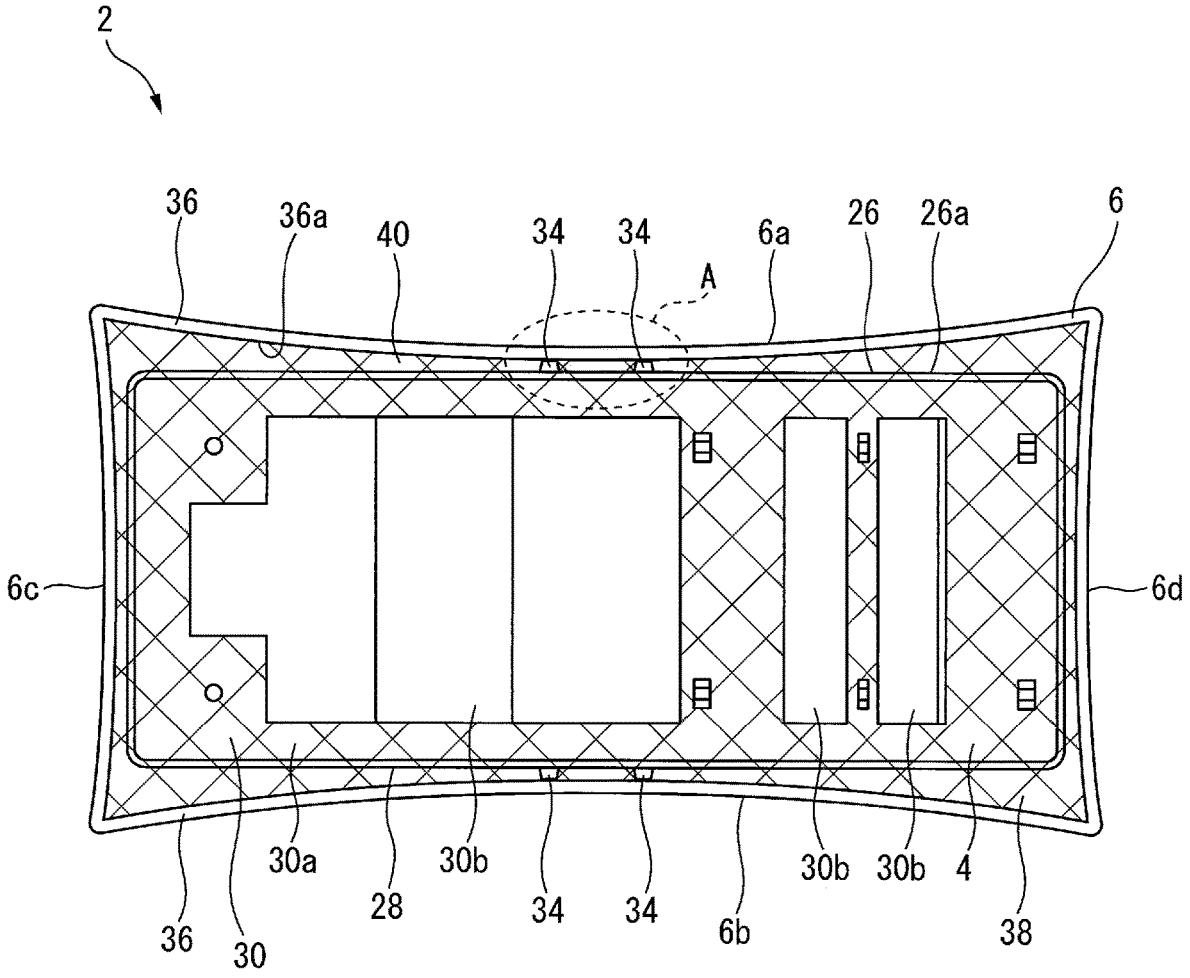
FIG. 6 is a bottom view of the electromagnetic relay.

FIG. 6 illustrates a bottom view of the relay 2. The cover 6 is represented by the rectangular outline. Note that in FIG. 6, due to the occurrence of warpage, the contour of the cover 6 is deformed from a rectangular shape to a curved shape. The cover 6 further includes an inner surface 36*a*. The inner surface 36*a* and the surface 26*a* face each other.

The cover 6 is formed, for example, as a thin resin part having a thickness of less than 1 mm, and as illustrated in FIG. 6, warpage occurs after molding such that the cover 6 bends inward near the center of each side near the open end 36.

The degree of warpage depends on the thickness of cover 6 and the lengths of the sides thereof as compared with the same material and molding conditions. For example, the warpage is reduced as the thickness of the cover 6 increases. Furthermore, the warpage is reduced as the side length of the cover 6 decreases. In FIG. 6, the warpage between the side parts 6*a* and 6*b* and the side parts 6*c* and 6*d* is less in the side parts 6*c* and 6*d*, which have shorter lengths.

The adhesive 38 is arranged on the lower surface side of the relay 2 by, for example, application. For example, the adhesive 38 is made of an epoxy resin, and includes a primary agent and a curing agent.

The cross-hatched portion in FIG. 6 represents the adhesive 38. As illustrated in FIG. 6, the adhesive 38 is applied to the surface 30*a* and the gap 40 between the housing 4 and the cover 6. When the adhesive 38 in a liquid state is applied, the adhesive applied to the surface 30*a* flows into the gap 40 prior to curing.

The adhesive 38 is not applied to the protrusion 30*b*. By providing the protrusion 30*b*, the amount of adhesive 38 can be reduced while securing sufficient adhesive strength for the adhesive 38 to secure the housing 4 and the cover 6 to each other, whereby a cost reduction in the relay 2 can be realized.

Figure 7:
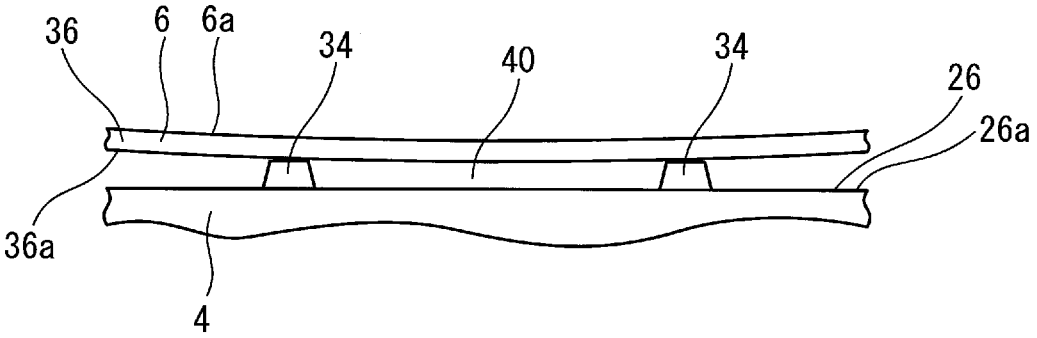
FIG. 7 is an enlarged bottom view of a projection according to the first embodiment.

FIG. 7 is an enlarged view of the area "A" surrounded by the dashed line in FIG. 6, which represents an enlarged view of the vicinity of the center of the warpage of the side part 6*a*.

Projections 34 are arranged in the vicinity of the center of the side part 6*a* at positions facing the surface 36*a*, and the tips thereof contact the inner surface 36*a*. Since the projections 34 contact the inner surface 36*a*, the center portion of the inner surface 36*a*, which is bent inward, is pushed outward. Since the projections 34 push the inner surface 36*a* outwardly, warpage of the open end 36 can be at least partially corrected, whereby the gap 40 can be secured across the entirety of the open end 36.

By providing projections 34 on the housing 4, the gap 40 can be secured across the entirety of the open end 36, and thus, a sufficient amount of the adhesive 38 can be applied seamlessly between the surface 26*a* and the housing 4. Furthermore, when the adhesive 38 is formed from an adhesive including a primary agent and a curing agent, if the gap 40 is secured across the entirety of the open end 36, separation of the primary agent and the curing agent can be prevented, and the adhesive can be appropriately cured. It is preferable that the width of the gap 40 is about 0.1 mm at the narrowest point thereof, and the height of the projection 34 is preferably 0.1 mm.

The projections 34 are formed in arbitrary positions of the side part 26 for contacting and pressing the side part 6*a*. The projections 34 may be formed in arbitrary positions on the surfaces 26*a* and 26*c*. Furthermore, when the entirety of the side part 26 is formed as a single surface, projections 34 may be formed at arbitrary positions of this surface.

Projections 34 are also formed on the side part 28. Furthermore, projections 34 are formed in arbitrary positions for contacting and pushing the side part 6*c* or 6*d*.

Figure 8:
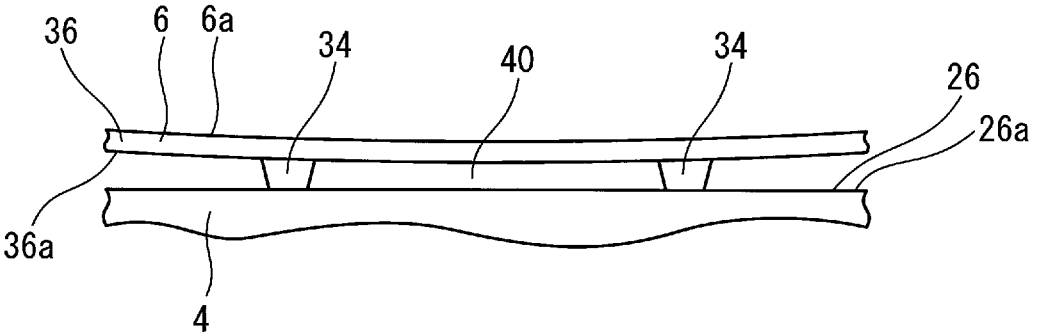
FIG. 8 is an enlarged bottom view of a modified projection.

As illustrated in FIG. 8, projections 34 are formed on the inner surface 36*a*, and contact and press the surface 26*a*, which is opposite thereto, whereby the gap 40 can be secured across the entirety of the open end 36.

Figure 9:
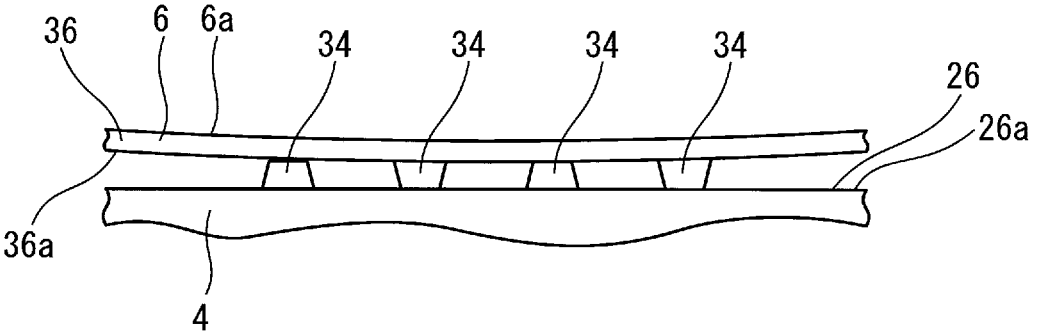
FIG. 9 is an enlarged bottom view of a modified projection.

As illustrated in FIG. 9, projections 34 may be formed on both the inner surface 36*a* and the surface 26*a*. The projections 34 may be formed on the cover 6 and the housing 4 so as to alternate. By forming projections 34 on both the housing 4 and the cover 6, the contact area of the housing 4 and the cover 6 with the adhesive 38 is increased, and thus, the adhesive strength between the adhesive 38 and the housing 4 and the cover 6 can be increased.

Figure 10:
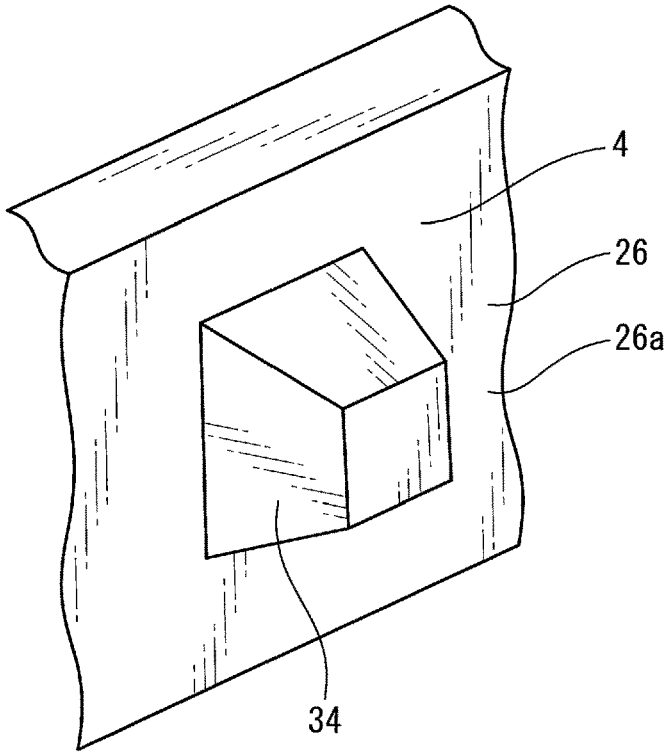
FIG. 10 is an enlarged perspective view of the projection.
Figure 11:
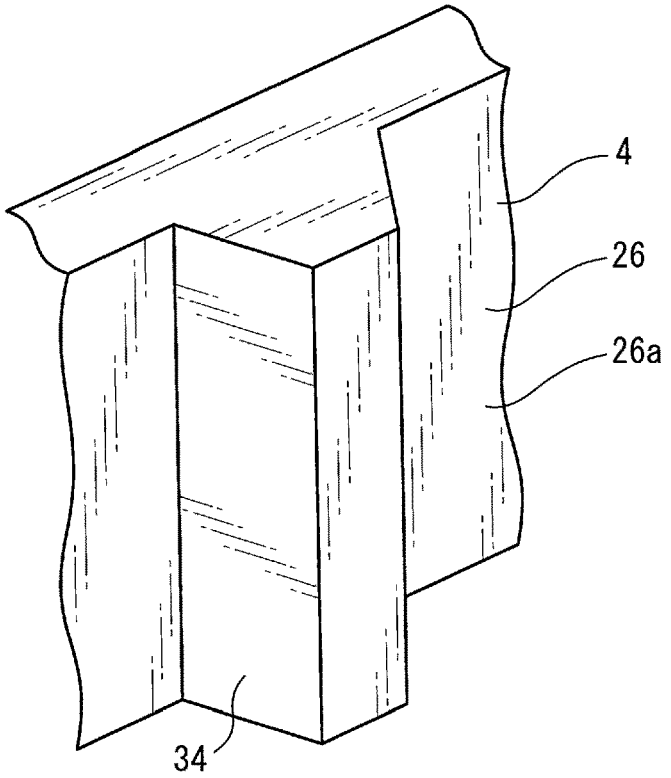
FIG. 11 is an enlarged perspective view of a modified projection.

The projection 34 is tapered, and is formed in a square frustum shape as illustrated in FIG. 10. Alternatively, the projection 34 may be formed as a quadrilateral column extending from the lower end to the upper end of the surface of the housing 4 or the cover 6. FIG. 11 depicts a projection 34 which extends from the lower end of the surface 26*a* and which is formed as a quadrilateral column having a trapezoidal base. When the housing 4 or the cover 6 is a resin part, the tapered shape facilitates injection molding.

Figure 12:
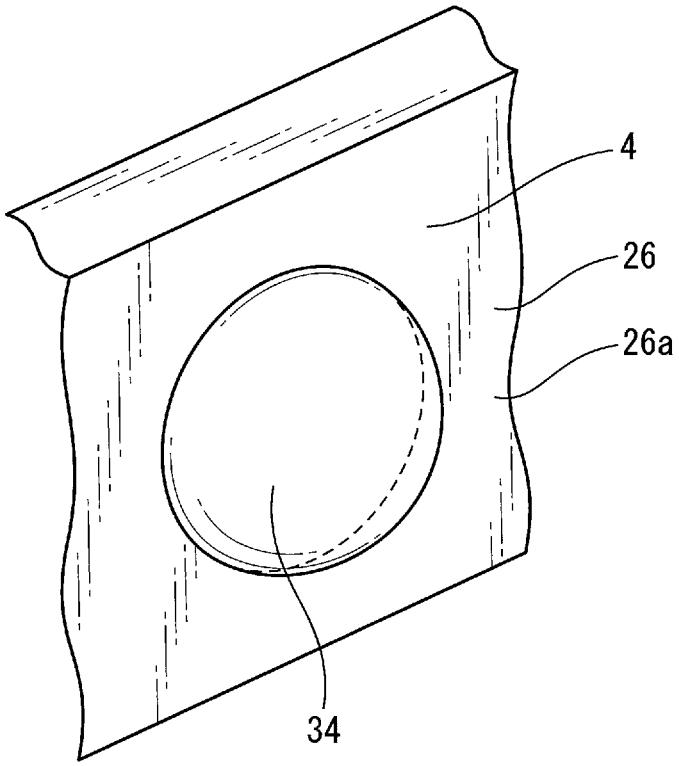
FIG. 12 is an enlarged perspective view of a modified projection.

Furthermore, the projection 34 may be formed in the spherical shape illustrated in FIG. 12. The spherical shape includes a hemisphere shape. With a shape lacking corners such as a spherical shape, the projection 34 is less likely to be scraped when contacting the housing 4 or the cover 6. Thus, it is possible to prevent the swarf, which may be generated as a result of the scraping, from entering into the interior of the housing 4.

Relay 42 according to a second embodiment will be described using FIGS. 13 to 17. The structure of the relay 42 is the same as that of the relay 2, and thus, an explanation therefor will not be repeated.

Figure 13:
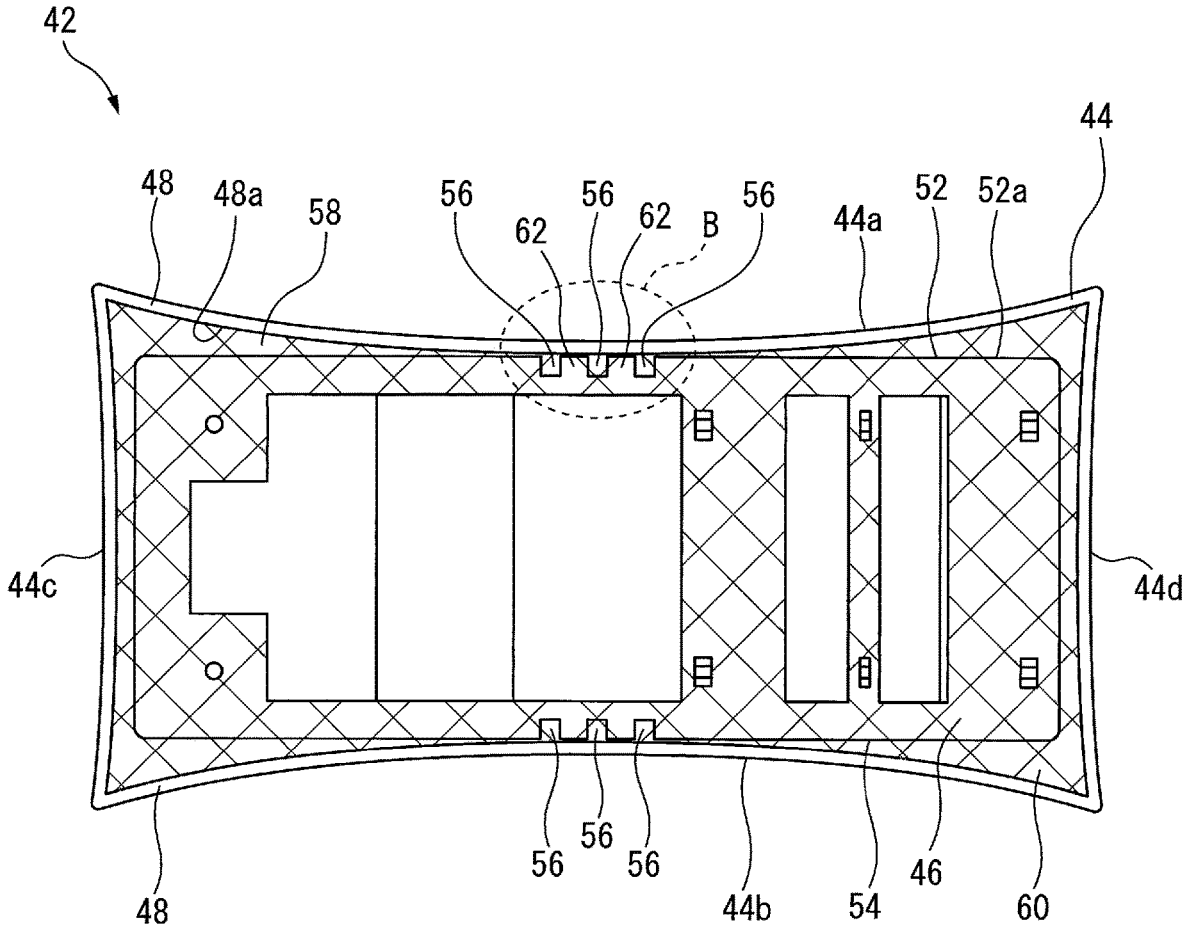
FIG. 13 is a bottom view of an electromagnetic relay according to a second embodiment.

FIG. 13 is a bottom view of the relay 42. The relay 42 includes a cover 44, and a housing 46. The cover 44 includes side parts 44*a* and 44*b*, side parts 44*c* and 44*d*, and an inner surface 48*a*.

Figure 14:
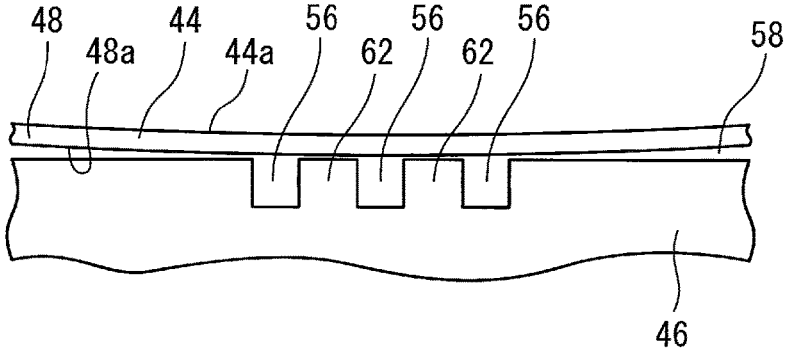
FIG. 14 is an enlarged bottom view of the electromagnetic relay.
Figure 15:
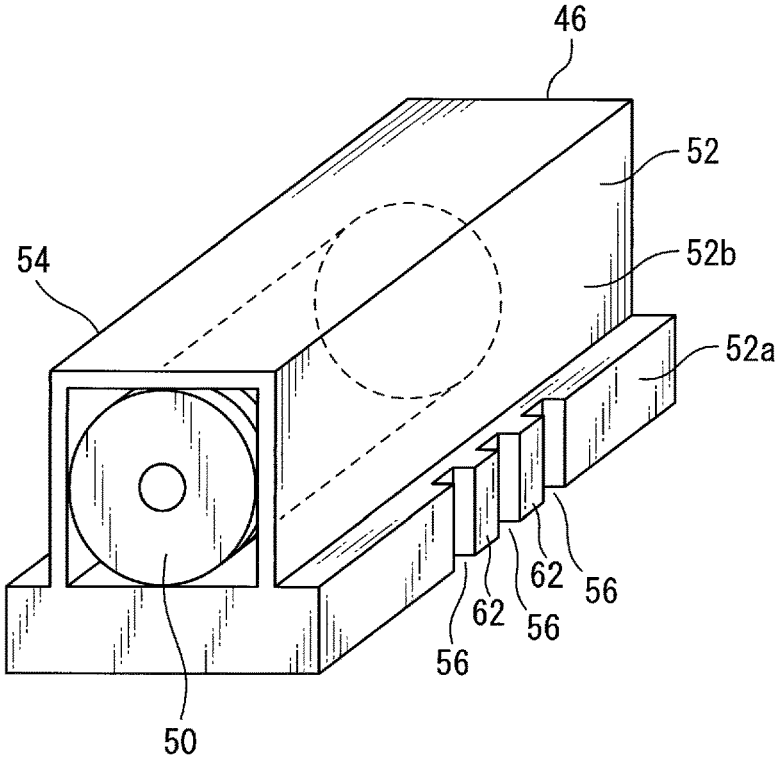
FIG. 15 is a perspective view of a housing including a first recess according to the second embodiment.

FIG. 14 is an enlarged view of the area B encircled by the dashed line in FIG. 13. The area B depicts an enlarged view of the warpage in the vicinity of the center of the side part 44*a*. FIG. 15 is a perspective view of the housing 46, which is assembled with a coil assembly 50. As illustrated in FIG. 15, the housing 46 includes side parts 52 and 54. The side part 52 includes a surface 52*a* and a surface 52*b*.

First recesses 56 are formed in the surface 52*a* in the vicinity of the center of the cover 44 so as to be open on the lower and upper ends of the surface 52*a*. One end of each first recess 56 is open toward the open end 48 side. An arbitrary number of first recesses 56 are formed.

The entirety of the side part 52 may be formed as a single surface. When the entirety of the side part 52 is formed as a single surface, the first recesses 56 are formed so as to be open on the lower and upper ends of the side part 52.

Figure 16:
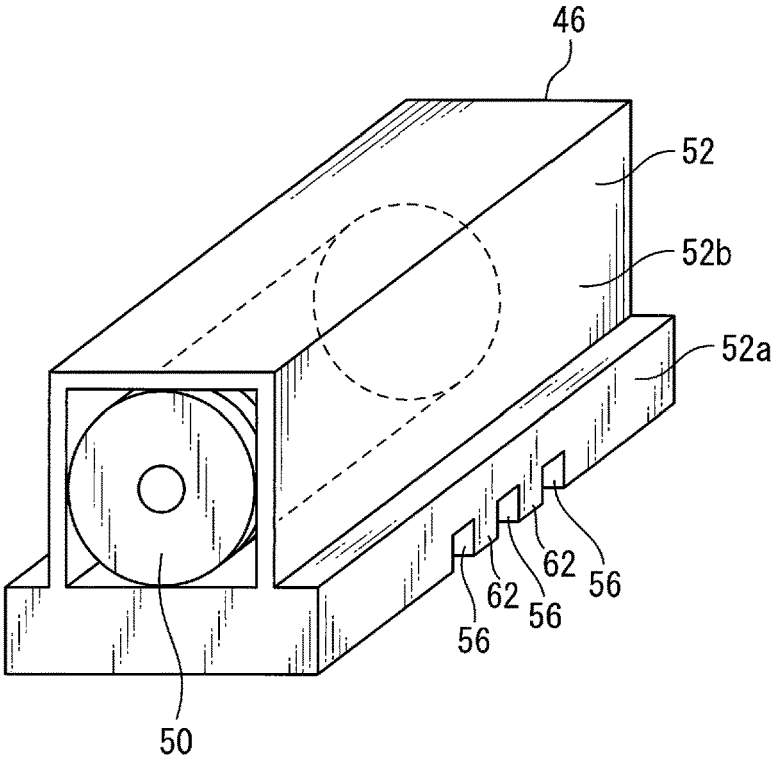
FIG. 16 is a perspective view of the housing with a modified first recess according to the second embodiment.

FIG. 16 is a perspective view of the housing 46 with a modified first recess 56. The first recesses 56 in FIG. 16 are open on the bottom end of the surface 52, and are formed in cubic shapes.

As illustrated in FIG. 13, the width of the gap 58 between the cover 44 and the housing 46 is reduced in the vicinity of the center of the cover 44. However, since the housing 46 includes first recesses 56, and the adhesive 60 can be applied in the first recesses 56, a sufficient amount of adhesive 60 can be applied between the surface 52*a* and the inner surface 48*a* without interruption.

Furthermore, when the adhesive 60 is formed from an adhesive including a primary agent and a curing agent, since the adhesive 60 can flow into the first recesses 56 in the vicinity of the warpage of the cover 44, whereby bleeding can be prevented and the adhesive can be appropriately cured.

In FIG. 13, projections 62 are formed by the first recesses 56. The contact area between the housing 46 and the adhesive 60 can be increased by the projections 62, whereby the adhesive strength therebetween can be increased. Note that the depths of the first recesses 56 and the heights of the projections 62 are assumed to be, for example, approximately 1 mm.

The contact between the side part 44*a* and the projections 62 depends on the degree of warpage of the cover 44. However, the warpage of the side part 44*a* can be reduced by supporting the side part 44*a* with which the projections 62 contact.

Figure 17:
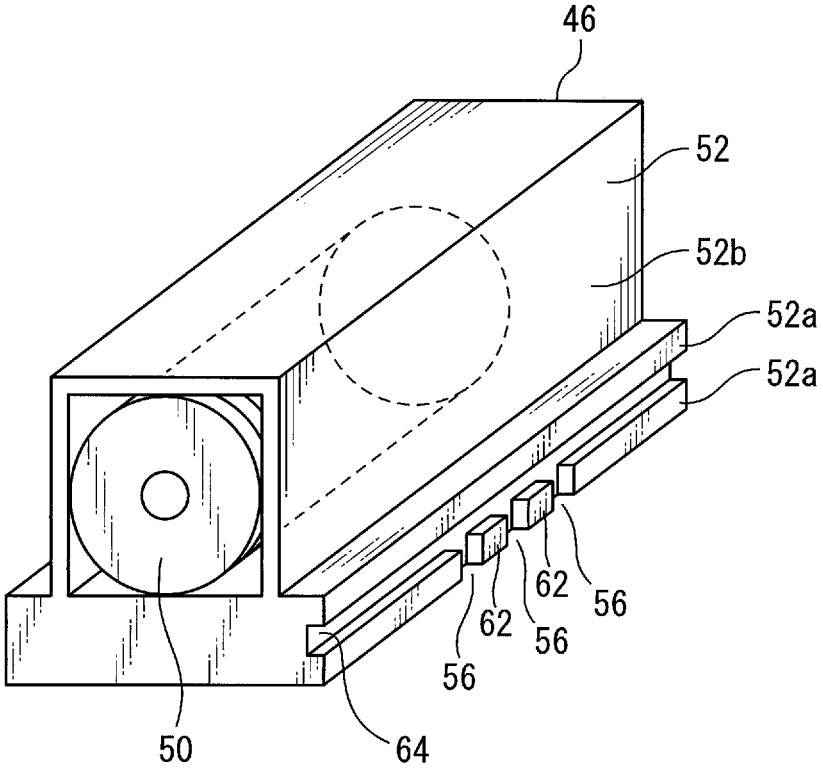
FIG. 17 is a perspective view of the housing with a modified first recess and a second recess according to the second embodiment.

FIG. 17 is a perspective view of a modified example of the relay 42. The housing 46 illustrated in FIG. 17 includes a second recess 64 in addition to the first recesses 56. The first recesses 56 and the second recess 64 are formed in the surface 52*a*, and the second recess 64 communicates with one end of each first recess 56.

The second recess 64 is formed in a position separated from the open end 48 with respect to the first recesses 56. The second recess 64 may be open on both ends of the surface 52*a*. Alternatively, the second recess 64 may not be open on both ends of the surface 52*a*, and may be formed so as to be open only on the cover 44 side.

Adhesive 60 is filled in the first recesses 56 and the second recess 64. By filling the adhesive 60 in not only the first recesses 56 but also in the second recess 64, adhesive strength can be further improved.

Note that the first recesses 56 and the second recess 64 may have arbitrary shapes. For example, the first recesses 56 and the second recess 64 may be tapered, or may be curved.

Furthermore, the first recesses 56 and the second recess 64 may be formed at arbitrary positions in the housing 46 so as to increase adhesive strength. For example, a recess may be formed in the side part 54.

The first recesses 56 and the second recess 64 may be formed in the cover 44. When recesses are formed in the side part 44*a*, the first recesses 56 are open toward the open end 48 side, and the second recess 64 communicates with one end of each first recess 56 and is formed in a position away from the open end 48 with respect to the first recess 56.

The first recesses 56 may be formed in the housing 46 and the second recess 64 may be formed in the cover 44. In this case, the first recesses 56 and the second recess 64 communicate with each other when the cover 44 contacts the housing 46. When the cover 44 and the housing 46 are resin parts, providing the first recesses 56 and the second recess 64 in separate parts facilitates individual injection molding.

The embodiments described above can be appropriately combined. Furthermore, in the drawings described above, identical or corresponding portions have been assigned the same reference numerals. Note that the embodiments described above are exemplary and do not limit the invention.

The invention claimed is:

1. An electromagnetic relay, comprising:

a housing which includes an outer side part, the outer side part having a plurality of outer side part edges;

a cover which covers the housing, and includes an inner surface which faces the outer side part when the cover is covering the housing, the inner surface having a plurality of inner surface edges;

a projection which is formed on at least one of the outer side part and the inner surface and contacts with the other one of the outer side part and the inner surface when the cover is covering the housing; and an adhesive which is interposed and filled in a gap between the outer side part and the inner surface while the projection contacts with the other one of the outer side part and the inner surface, wherein the projection contacts with the other one of the outer side part and the inner surface to secure the gap between the outer side part and the inner surface, and wherein the projection is away from all of the plurality of outer side part edges when the projection contacts the outer side part or away from all of the plurality of inner surface edges when the projection contacts the inner surface.

2. The electromagnetic relay according to claim 1, wherein:

a plurality of projections are formed on at least one of the outer side part and the inner surface, and each of the projections contacts with the other of the outer side surface and the inner surface.

3. The electromagnetic relay according to claim 2, wherein:

the outer side part and the inner surface do not contact each other in a space between the projections.

* * * * *